United States Patent [19]

Nakauchi

[11] Patent Number: 4,854,619

[45] Date of Patent: Aug. 8, 1989

[54] ELECTRIC KEY

[75] Inventor: Shunsaku Nakauchi, Mitaka, Japan

[73] Assignee: RYOBI Ltd., Japan

[21] Appl. No.: 156,753

[22] Filed: Feb. 18, 1988

[30] Foreign Application Priority Data

Feb. 23, 1987 [JP] Japan ..... 62-39727

[51] Int. Cl.[4] ..... E05B 47/00

[52] U.S. Cl. ..... 292/335; 292/144; 292/150

[58] Field of Search ..... 292/144, 150, 153, 173, 292/335

[56] References Cited

U.S. PATENT DOCUMENTS

| | | | |
|---|---|---|---|
| 1,361,317 | 12/1920 | Dulczewski et al. | 292/144 X |
| 1,377,061 | 3/1921 | Deeg | 292/144 X |
| 1,405,369 | 1/1922 | Watson | 292/144 |
| 2,466,481 | 4/1949 | Royal | 292/144 |
| 2,786,701 | 3/1957 | Povlich | 292/144 |
| 3,069,193 | 12/1962 | Kirk | 292/144 |
| 3,751,086 | 8/1973 | Geringer | 292/144 |

FOREIGN PATENT DOCUMENTS

| | | | |
|---|---|---|---|
| 330503 | 10/1935 | Italy | 292/335 |
| 188267 | 3/1937 | Switzerland | 292/335 |

OTHER PUBLICATIONS

Japanese Patent Laid Open Publication No. 38800/1974.

Japanese Patent Publication No. 45278/1976.

Japanese Patent Publication No. 53900/1971.

*Primary Examiner*—Peter R. Brown

*Attorney, Agent, or Firm*—Oliff & Berridge

[57] ABSTRACT

An electric key has a self-holding electromagnet for attracting movable means holding a locking block in its nonconductive state and for releasing the movable means in its conductive state by a spring. The movable means is returned by a hand-operation to a position where it is attracted on the electromagnet. This results in the saving of electric power.

6 Claims, 2 Drawing Sheets

ELECTRIC KEY

BACKGROUND OF THE INVENTION

This invention relates to an electric key operated by electric signals, and more particularly, to an electric key which can be operated with a small amount of electric power.

In a conventional electric key operated by electric signals, a locking and unlocking motion is carried out by a solenoid or a motor. However, in order to operate the solenoid or the motor, electric power of several watts usually or several tens of watts must be conducted for over 100 msec. That isf electric power of more than 1 joule is consumed when the door is locked and unlocked.

Therefore, when a dry battery is used as a power source, service life span of the dry battery is very short even if the dry battery has a large capacity, thereby requiring exchange of dry batteries within a short time of one year or less than one year.

This type of electric keys is disclosed in Japanese Patent Laid Open Publication No. 38800/1974 and Japanese Patent Publication No. 45278/1976. An electric key disclosed in Japanese Patent Laid Open Publication No. 38800/1974 has an electromagnetic means which accomodates a permanent magnet for keeping a movable magnetic core at locked and unlocked positions. That is, conduction in the electromagnetic means is not necessary for maintaining the movable magnetic core at two respective locked and unlocked positions. However, the electromagnetic means must be energized or conducted to move the movable magnetic core from the locked position to the unlocked position and vice versa while distinguishing the magnetic flux of the permanent magnet.

Further, Japanese Patent Publication No. 45278/1976 also discloses an electromagnetic means having an armature to be operated by an electromagnet. Also in this case, the electromagnetic means must be energized to decrease or cancel the magnetic flux of a permanent magnet in both cases where the key is locked and unlocked. In these electromagnetic means, the movable magnetic core and the armature are moved through a space of 2 to 4 mm, respectively. This motion needs a big amount of electric power because the ampere-turn for obtaining magnetic flux necessary for a space is in proportion to the length of the space and the electric power is in proportion to the square of the ampere-turn.

Accordingly, as these disclosed electric keys require a big amount of electric power, the life span of dry batteries used for these keys is very short.

SUMMARY OF THE INVENTION

It is an object of this invention to provide an electric key which requires only a small amount of electric power and can be operated in a stabilized fashion.

According to this invention, there is provided an electric key having a latch head moved into and out of a key hole, and a locking means for locking the latch head, the electric key comprising; (a) movable means for holding the locking means; (b) a self-holding type electromagnetic means for attracting the movable means in its nonconductive state and for releasing the movable means therefrom in its conductive state; and, (c) returning means for returning the movable means to a position where the movable means is attracted by the electromagnetic means, the returning means being provided on a movable part moved by a hand operation.

BRIEF DESCRIPTION OF THE DRAWINGS

In the accompanying drawings.

DETAILED DESCRIPTION OF THE INVENTION

Figure 1:
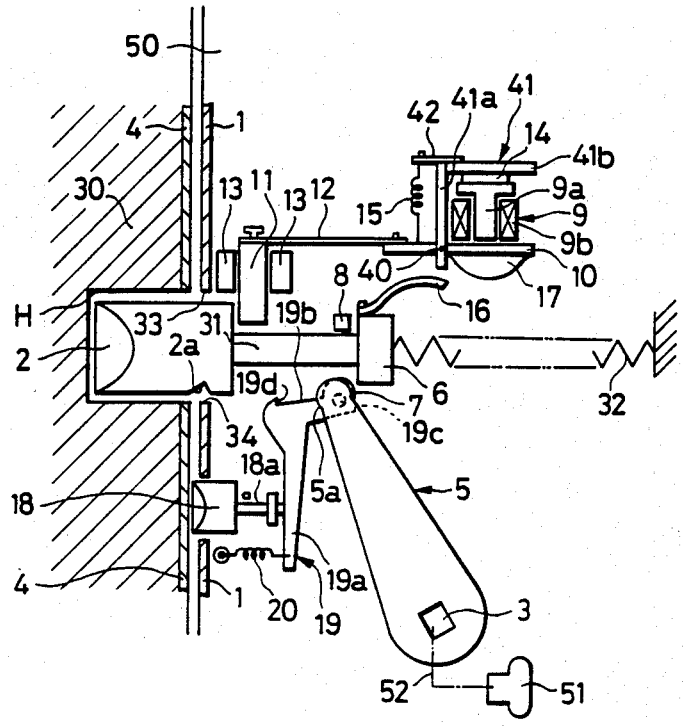
FIG. 1 is a diagrammatic view showing an electric key according to this invention in a locked state.

FIG. 1 is a diagrammatic view of an embodiment according to this invention and shows a locked state of an electric key.

In FIG. 1, the electric key of this invention has a latch head 2 which is insertable into a key hole H provided on a side face of a wall 30 when a door 50 is locked. The latch head 2 is formed with a recess 2*a* at an outer peripheral surface therof. The latch head 2 is connected to a latch shaft 31 whose rear end has a latch end portion 6. On the peripheral surface of the latch end portion 6, an arched spring piece 16 is provided. The latch end portion 6 is connected with an end of a spring 32, thereby to cause the latch head 2 to be urged toward the key hole H. Along the latch shaft 31 is provided a stop member 8 for stopping the movement of the latch end portion 6 toward a direction of the key hole H.

The wall 30 has a protection plate 4 on its side face opposite to a front panel 1 of a key main body (not shown). The front panel 1 is provided with two engaging openings 33, 34 for slidably receiving the latch head 2 and a trigger operating member 18 cooperating with the protection plate 4, respectively. The trigger operating member 18 has a shaft 18*a* whose rear end abuts against an L-shaped trigger 19 at its tail portion 19*a*. The trigger 19 comprises the tail portion 19*a* which extends in vertical direction during a locking state of the door 50, and an arm portion 19*b* whose front end is pivotably supported by a pin 19*c*. The lower end of the tail portion 19*a* is connected to one end of a tension spring 20 for urging the trigger 19 to rotate in clockwise direction in FIG. 1. The trigger 19 has a hook portion 19*d* for cooperating with the recess 2*a* formed on the outer surface of the latch head 2.

Near the latch end portion 6 is located an upper end 5*a* of a lever 5 whose lower end has a rectangular hole 3 for engaging with a knob shaft 52 of a door knob 51 having a rectangular cross-section. Adjacent the engaging opening 33 is provided a locking block 11 which is supported at the front end of a leaf spring 12 and which is guided slidably by two stopping blocks 13, 13 while supporting a retracting force exerted on the latch head 2 by the spring 32 in the right direction as viewed in FIG. 1. That is, the locking block 11 is vertically movable to be in contact with a rear planar face of the latch head 2, so that retracting movement of the latch head 2 by the biasing force of the spring 32 is restrained by the descending locking block 11.

The leaf spring 12 is connected to a swingable iron piece 10 which is supported swingably by a pin 40 at the lower end of a support frame 41 having L-shaped configuration. The support frame 41 has a vertical portion 41*a* and a horizontal portion 41*b*. On the left side of the horizontal portion 41*b* is fixed a support plate 42 which is connected to the upper end of the tension spring 15 whose lower end is connected to the left portion of the iron piece 10 with respect to the vertical portion 41*a* of the support frame 41. The right portion of the iron piece 10 has a projected portion 17 for cooperating with the spring piece 16 fixed to the latch end portion 6.

The horizontal portion 41*b* of the support frame 41 is fixed with a permanent magnet 14 abutting against the upper portion of the magnetic core 9*a* of an electromagnet 9 around which coils 9*b* are wound. Magnetic flux of the permanent magnet 14 flows in the magnetic core 9*a* to attract the iron piece 10 in a normal state wherein the electromagnet 9 is deenergized. However, when the electromagnet 9 is energized, the magnetic flux from the permanent magnet 14 is cancelled by a magnetic flux produced by the electromagnet 9.

The operation of this electric key will now be explained.

FIG. 1 shows a locked state of the door 50. That is, the latch head 2 is located in the key hole H in a state wherein the rear face of the latch head 2 abuts against the lower portion of the locking block 11 to prevent the latch head 2 from moving rearwardly. Further, at this time, the iron piece 10 is held on the lower end of the magnetic core 9*a* by magnetic force of the permanent magnet 14 against the biasing force of the tension spring 15. This locked state is kept by the magnetic flux of the permanent magnet 14 without consuming electric power. The trigger 19 is held in a nonoperating state wherein the tail portion 19*a* is held by the rear end of the trigger operating member 18 whose front face abuts against the protection plate 4 on the wall side, while expanding the tension spring 20.

In this state, if a man who wishes to open the door 50 inserts a magnetic card or the like into a code read-out portion of a card reader, and if the inserted card is judged as a true or right card, the electromagnet 9 is energized. At this time, electric current flows in a direction where the magnetic flux of the permanent magnet 14 holding the iron piece 10 through the magnetic core 9*a* of the electromagnet 9 is decreased or cancelled. Therefore, the magnetic flux holding the iron piece 10 is decreased or weakened whereby the spring force of the spring 15 becomes larger than the difference in magnetic strength between the permanent magnet 14 and the electromagnet 9. As a result, the iron piece 10 is released from the magnetic force of the permanent magnet 14, so that the iron piece 10 is rotated about the pin 40 in clockwise direction in FIG. 1.

Figure 2:
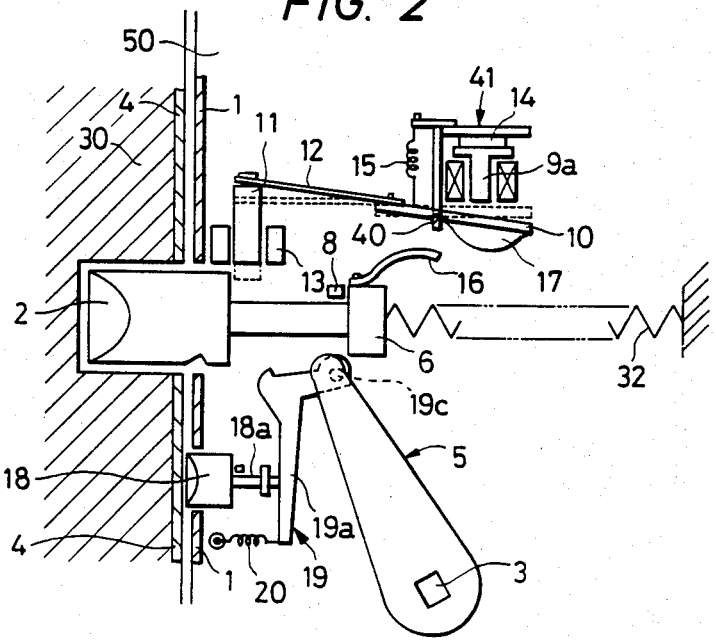
FIG. 2 is a diagrammatic view of the invention showing a state wherein the key is unlocked.

FIG. 2 shows this state, and accordingly, the locking block 11 slidingly moves upwardly along the stopping blocks 13, so that the locking block 11 is disengaged from the rear planar face of the latch head 2, thereby enabling the latch head 2 to retract in the right direction as viewed in FIG. 2. That is, the locking block 11 is moved upward from a position indicated by a broken line to a position indicated by a solid line in FIG. 2. At this time, the iron piece 10 is reliably moved by only the spring force of the spring 15 without consuming any electric power in the electromagnet 9. The electromagnet 9 requires only a small amount of electric power necessary for decreasing or cancelling the magnetic flux of the permanent magnet 14 until the spring force of the spring 15 becomes larger than an attracting force of the permanent magnet 14 to release the iron piece 10 from the lower end of the magnetic core 9*a*. Further, as the electromagnet 9 is energized to generate magnetic flux in a state wherein the iron piece 10 contacts the lower end of the magnetic core 9, that is, a magnetic circuit is closed, only a small amount of electric power is required. In addition, the conduction period of time is short since very the period of time from the state wherein the iron piece 10 contacts the lower end of the magnetic core 9*a* until the state wherein iron piece 10 starts to separate therefrom is very short. According to an example, only about 5 msecs. were required as the conduction period of time.

Figure 3:
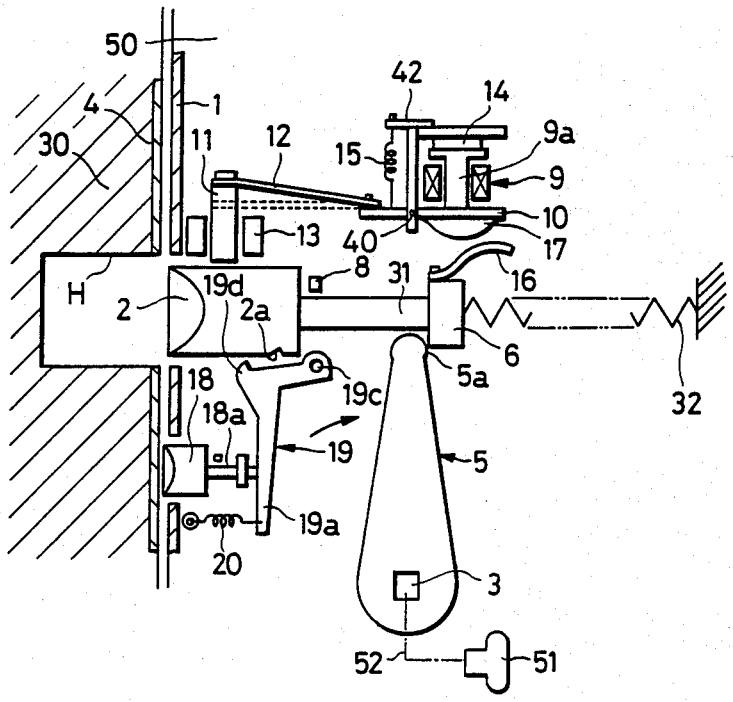
FIG. 3 is a diagrammatic view of the invertion showing a state wherein a door knob is rotated; and, FIG. 4 is a diagrammatic view of the invention showing a state wherein a door knob is released after the door is opened.

In this state of FIG. 2, the door 50 is ready to open by moving the lever 5 manually in the clockwise direction to retract the latch head 2. FIG. 3 shows a state wherein the latch head 2 is retracted by rotating the lever 5. That is, when the lever 5 is swung in the clockwise direction while the upper end 5*a* of the lever 5 abuts against the end face of the latch end portion 6, the latch head 2 is retracted from the key hole H. When the latch end portion 6 is moved in the right direction as viewed in FIG. 3, the spring piece 16 abuts against the projected portion 17 to raise it, whereby the upper surface of the iron piece 10 is attracted by the magnetic force of the permanent magnet 14 on the lower face of the magnetic core 9*a*. At this time, the lower end of the locking block 11 is in sliding contact with the outer surface of the latch head 2 while bending the leaf spring 12 upwardly. Further, the trigger 19 is maintained by the trigger operating member 18 to release the latch head 2.

Figure 4:
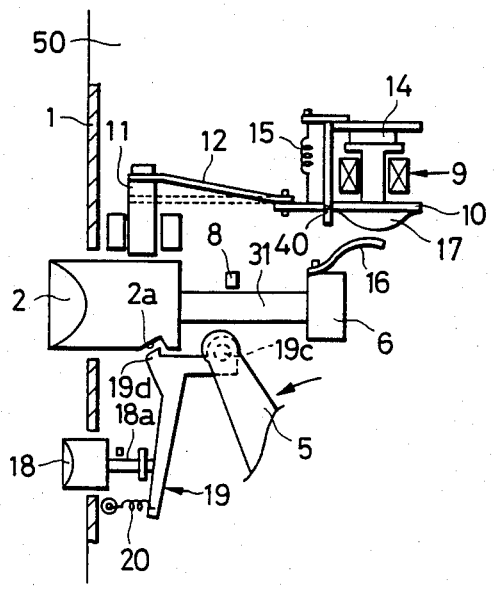

With this state, if the door 50 is opened as shown in FIG. 4, the trigger operating member 18 is released from the protection plate 4 on the side face of the wall 30, because the front panel 1 of the key main body is moved away from the side face of the wall 30. At this time, if the knob 51 (FIG. 1) connected to the lever 5 is released, that is, an operator releases his hand from the knob 51, the latch head 2 is moved by a biasing force of the spring 32 in the left direction. When the latch head 2 is projected to an intermediate position while the upper face of the latch head 2 slides the lower end face of the locking block 11, the hook portion 19*d* of the trigger 19 is engaged with the recess 2*a* of the latch head 2 to stop movement of the latch head 2 in a condition wherein the trigger operating member 18 is projected from the front planar 1 of the key main body. At this time, the locking block 11 is in contact with the upper face of the latch head 2. With this intermediate state of the latch head 2, if the door 50 is closed, the trigger operating member 18 is pushed rearwardly or retracted by the protection plate 4 on the side face of the wall 30 to rotate the trigger 19 in the counterclockwise direction thereby to release the latch head 2 from the hook portion 19*d* of the trigger 19. As a result, the latch head 2 is projected to a position where the latch end portion 6 abuts against the stop member 8. At this time, as the lower end of the locking block 11 is released from the upper face of the latch head 2, the locking block 11 is lowered to restrain the backward movement of the latch head 2 as shown in FIG. 1, thereby to lock the door 50.

In this embodiment, in a normal state, the electromagnet 9 holds magnetic flux of the permanent magnet 14 to attract the iron piece 10. That is, the electromagnet 9 can be called a magnetism holding type electromagnet. However, the magnet 9 can be substituted for an electromagnet which can hold the iron piece 10 by other mechanical means in a normal state. In conclusion, a characteristic feature of this invention resides in the use of a self-holding type electromagnet which is conducted to operate it only when the electromagnet is changed from a holding state in which the magnet holds the iron piece 10 to a releasing state in which the magnet releases the iron piece 10. In case that the electromagnet is returned from the releasing state to the holding state, a hand-operation upon opening of the door 50 is utilized thereby to decrease consumption of electric power.

Further, in this invention, a combination of the arched spring piece 16 and the projected portion 17 fixed to the iron piece 10 is used as a returning means for pushing upwardly the movable iron piece 10 to return it to the self-holding electromagnet 9. However, the above returning means is not limited to this embodiment. The projected portion 17 is not necessarily required. The projected portion 17 may be provided on the latch end portion 6 while the arched spring piece 16 may be provided on the iron piece 10. Alternatively, the arched spring piece 16 may be provided on the upper end of the lever 5 instead of the latch end portion 6. In short, so long as a returning means (the spring 16 and the portion 17) for returning the iron piece 10 to a position where the self-holding electromagnet holds the iron piece 10 is provided on a movable portion (the latch end portion 6 or the lever 5) which can be moved by hand, there are no other restrictions or limitations with respect to the returning means.

In the above manner, in this invention, an operation for a locking motion in a series of motions (unlocking, door opening, door closing and locking motions) which needs electric power most in a conventional electric key is carried out by a hand-operation during the door opening motion. That is, the iron piece 10 is returned by the hand-operation in which the lever 5 is rotated, to a position where the piece 10 is attracted on the lower end of the magnetic core 19*a* while bending the leaf spring 12 to store or accumulate a locking force by which the locking block 11 is moved downwardly thereby to lock the latch head 2. In this invention, a small amount of electric power is used only when the door is unlocked and no additional electric power is not necessarily required since a locking force can be accumulated by the hand-operation, whereby consumption of electric power is remarkably decreased. Therefore, in an electric key using a dry battery, the length of its service life can be remarkably prolonged thereby to obtain an electric key which does not need exchange of dry battery during 5 to 10 years to thus facilitate its maintenance and to increase its practicality. Especially, if this electric key is adapted for an automatically locking type electric key for a door of a hotel or the like, high economical key unit is obtainable.

What is claimed is:

1. An electric key having a latch head movable into and out of a key hole, and locking means for locking said latch head, said electric key comprising:

(a) movable means for supporting said locking means thereon so that said locking means is moved between a position where said latch head is locked in said key hole and a position where said latch head is released from said key hole;

(b) self-holding type electromagnetic means for attracting said movable means thereto in its nonconductive state so that said locking means is urged into the position where the latch head is locked and for releasing said movable means in its conductive state so that said locking means is moved into the position where said latch head is released from the key hole; and (c) returning means for returning said movable means from a position where said movable means is released from said electromagnetic means so that said locking means releases said latch head to a position where said movable means is attracted by said electromagnetic means so that said locking means is urged toward the direction where said locking means locks said latch head in a state wherein said locking means releases said latch head, said returning means being moved together with said latch head when said latch is operated by rotation of a door knob.

2. An electric key according to claim 1, wherein said movable means comprises: a swingable iron piece and leaf spring connected to said iron piece to hold said locking means at its end, said movable means being supported by a spring for urging said iron piece so as to be separated from said electromagnetic means, said locking means abutting the rear face of said latch head to lock it when said latch lead is inserted deeply into said key hole and said iron piece is attracted by said electromagnetic means, said locking means releasing said latch head when said iron piece is released from said electromagnetic means, said locking means slidingly contacting the outer surface of said latch head when said locking means is urged toward the direction where said latch head is locked, and upon retraction of said latch head into a door by rotation of a door knob, said locking means being released from the outer surface of said latch head so as to abut the rear face of said latch head to lock it when said door is closed so that said latch head is deeply inserted into said key hole.

3. An electric key according to claim 1, wherein said electromagnetic means has a permenent magnet for attracting said iron piece through a magnetic core in a nonconductive state of said electromagnetic means, a magnetic flux of said permanent magnet being cancelled or decreased when said electromagnetic means is energized to release said iron piece therefrom so that said locking means releases said latch head.

4. An electric key according to claim 1, wherein said returning means comprises a spring piece fixed to a latch end portion for cooperating with a projected portion formed on said iron piece, said latch end portion being operated by a rotatable lever connected to said door knob through a knob shaft.

5. An electric key according to claim 1, further comprising rotatable trigger means having an engaging portion that engages a portion of said latch head in order to stop movement of said latch head and trigger operating means for operating said rotatable trigger means in accordance with opening and closing of said door, said trigger operating means being located in a retracted position where its front face contacts a protection plate of a wall so that said trigger means releases said latch head when said door is closed, said trigger operating means being projected so that said latch head is engaged with said engaging portion of said trigger means when said door is opened thereby maintaining said latch head in an intermediate position, said trigger operating means being retracted to rotate said trigger means so that said latch head is released when said door is closed.

6. An electric key according to claim 5, wherein said rotatable trigger means comprises a L-shaped trigger member which is urged by a spring in a direction where its tail abuts against said trigger operating means, said trigger member having a hook portion as said engaging portion for engaging with a recess of said latch head.

* * * * *